US008761619B2

(12) United States Patent
Kushima et al.

(10) Patent No.: US 8,761,619 B2
(45) Date of Patent: Jun. 24, 2014

(54) IMAGE FORMING DEVICE AND FAILURE CONTROL SYSTEM FOR THE SAME

(75) Inventors: Yasutaka Kushima, Tokyo (JP); Akira Nakayama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 184 days.

(21) Appl. No.: 13/350,935

(22) Filed: Jan. 16, 2012

(65) Prior Publication Data

US 2012/0189325 A1 Jul. 26, 2012

(30) Foreign Application Priority Data

Jan. 21, 2011 (JP) ..... 2011-011328

(51) Int. Cl.
*G03G 15/00* (2006.01)
*G03G 21/20* (2006.01)

(52) U.S. Cl.
USPC ..... 399/33; 399/92

(58) Field of Classification Search
USPC ..... 399/9, 18, 36, 37, 70, 92, 94
See application file for complete search history.

(56) References Cited

U.S. PATENT DOCUMENTS

| | | | | |
|---|---|---|---|---|
| 2003/0219274 | A1* | 11/2003 | Hirose et al. | 399/92 |
| 2008/0013981 | A1* | 1/2008 | Kimura et al. | 399/96 |
| 2009/0097204 | A1* | 4/2009 | Byers | 361/695 |
| 2011/0253698 | A1* | 10/2011 | Theodos et al. | 219/385 |

FOREIGN PATENT DOCUMENTS

| | | |
|---|---|---|
| JP | A-H04-251782 | 9/1992 |
| JP | A-H06-024096 | 2/1994 |
| JP | A-2004-106456 | 4/2004 |
| JP | A-2005-256617 | 9/2005 |
| JP | A-2009-025759 | 2/2009 |
| JP | A-2010-147810 | 7/2010 |

* cited by examiner

*Primary Examiner* — Clayton E Laballe
*Assistant Examiner* — Victor Verbitsky
(74) *Attorney, Agent, or Firm* — Muncy, Geissler, Olds & Lowe, P.C.

(57) ABSTRACT

An image forming device includes a plurality of power consumption parts that operate by power supply from a power source. The image forming device includes a failure detection part that detects occurrence of an unrecoverable failure, and a main controller that suppresses an amount of power supplied to the plurality of power consumption parts in response to detection by the failure detection part of the occurrence of an unrecoverable failure.

12 Claims, 8 Drawing Sheets

IMAGE FORMING DEVICE AND FAILURE CONTROL SYSTEM FOR THE SAME

CROSS REFERENCE TO RELATED APPLICATION

The present application is related to, claims priority from and incorporates by reference Japanese patent application No. 2011-011328, filed on Jan. 21, 2011.

TECHNICAL FIELD

The present application relates to an image forming device, such as a printer, a photocopy machine, a facsimile machine, a multi-function peripheral (MFP) and the like, and relates to a failure control system for the above devices.

BACKGROUND

A conventional image forming device determines whether to turn on and off a power source device depending on the condition of a failure that has occurred in the device, and whether to turn off the power source that supplies power to the entire device when an unrecoverable failure occurs, in order to save unnecessary power consumption (see Japanese Laid-Open Patent Application No. 2010-147810 (paragraphs [0068]-[0076] and FIG. 2), for example). In the applications, the "unrecoverable failure" means a failure that may be caused by heat generated by components and the like inside the device and that is difficult to overcome by the device itself, and that might damage the device. For example, an abnormal rotation and low performance of a cooling fan that are caused by a power supply error, are included. A case where a cooling fan stops due to accumulated dust or waste is as well.

However, in the above-described conventional technology, when the unrecoverable failure occurs, the entire device is always stopped because the power source that supplies power is turned off. Therefore, there is a problem that it is inconvenient for the user, as the device cannot be used until the device has recovered from the failure. The present application has an object to solve the above-described problem and to maintain the user's convenience by allowing the device to be used even when the unrecoverable failure occurs.

SUMMARY

Therefore, the present invention is an image forming device that includes a plurality of power consumption parts that operate by power supply from a power source. The image forming device includes a failure detection part that detects occurrence of an unrecoverable failure, and a main controller that suppresses an amount of power supplied to the plurality of power consumption parts in response to detection by the failure detection part of the occurrence of an unrecoverable failure.

The present application has an advantage to secure the user's convenience even when the unrecoverable failure occurs.

In another view, an image forming device of the present invention includes a plurality of power consumption devices that operate by power supply and a plurality of cooling devices that cool a portion of the plurality of power consumption devices that requires cooling. The plurality of power consumption parts include a fuser that fixes a developer image transferred onto a recording medium to the recording medium and a power source to which power is supplied from a commercial power source. The image forming device includes: a failure detection part that detects occurrence of an unrecoverable failure at one of the plurality of cooling devices; a tubular connection member that connects a fuser cooling area in which cooling air of one of the plurality of cooling devices that cools the fuser flows, and a power source cooling area in which cooling air of one of the plurality of cooling devices that cools the power source flows; an openable and closeable isolation plate that isolates the cooling air that flows through the connection member; and a main controller that opens and closes the isolation plate in response to the cooling device for which the occurrence of an unrecoverable failure is detected by the failure detection part. The main controller opens the isolation plate when the failure detection part detects the occurrence of an unrecoverable failure at the cooling device that cools the power supply or the fuser.

In another view, the present application discloses a failure control system for an image forming device including: a plurality of power consumption parts including first and second heat generating parts; first, second and third cooling parts that cool the first and second heat generating parts and a main controller, respectively; a failure detection part configured to detect an unrecoverable failure at the first, second and third cooling parts; and the main controller that controls the plurality of power consumption parts and the first, second and third cooling parts. The main controller cuts power supply to a part of the plurality of power consumption parts when the failure detection part detects an unrecoverable failure at the first cooling part, the main controller operates the second heat generating part for extended time intervals when the failure detection part detects an unrecoverable failure at the second cooling part, and the main controller either operates the plurality of power consumption parts for the extended time intervals or suspends supply of a recording medium from a secondary medium accommodation part when the failure detection part detects an unrecoverable failure at the third cooling part.

DETAILED DESCRIPTION OF EMBODIMENTS

Embodiments of an image forming device according to the present application are explained below with reference to the drawings.

First Embodiment

Figure 2:
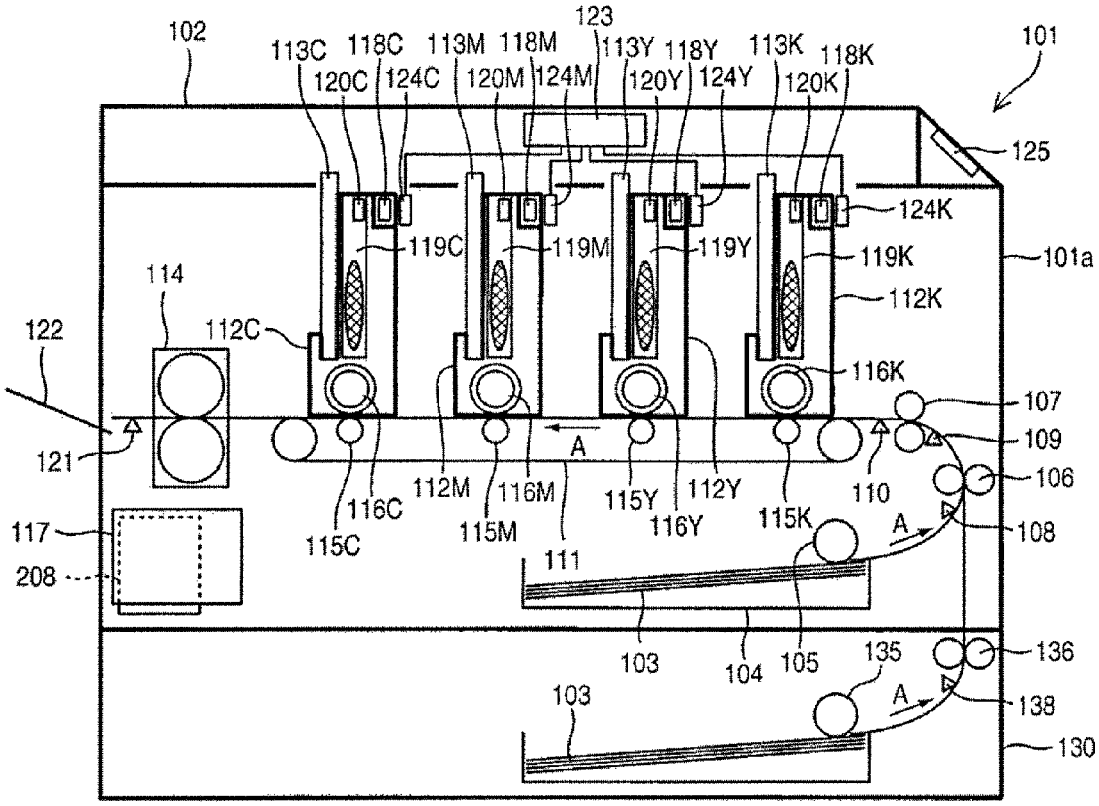
FIG. 2 is a schematic side cross-sectional view illustrating a configuration of the image forming device according to the first embodiment.

FIG. 2 is a schematic side cross-sectional view illustrating a configuration of the image forming device according to a first embodiment. In FIG. 2, reference numeral 101 is a printer as the image forming device. The explanation is made with an electrographic type color printer in the present embodiment as an example. Reference numeral 102 is a top cover part that is mounted openably and closably to an upper part of the printer 101. FIG. 2 is a left-side cross sectional view of the printer 101. The right side of the figure shows a front side 101*a* of the printer 101.

An image is printed on a recording medium 103 by the printer 101. The recording medium 103 is accommodated in a recording medium accommodation part 104 provided at a lower part of the printer 101. A sheet supply roller 105 is provided above the recording medium accommodation part 104. The sheet supply roller 105 separates and supplies, by rotation, each recording medium 103 accommodated in the recording medium accommodation part 104 in the direction A in the figure.

A first registration roller pair 106 and a second registration roller pair 107 are carrying roller pairs that pinch the recording medium 103 supplied by the sheet supply roller 105 and that carry the recording medium 103 to an image forming part. An IN1 sensor 108 is a travelling system sensor that is provided on the upstream side of the first registration roller pair 106 in the carrying direction (direction indicated by arrow A in the figure) of the recording medium 103 and that detects arrival of the recording medium 103.

An IN2 sensor 109 is a travelling system sensor that is provided on the upstream side of the second registration roller pair 107 in the carrying direction (direction indicated by arrow A in the figure) of the recording medium 103 and that detects that the recording medium 103 has arrived. A WR sensor 110 is a travelling system sensor that is provided on the downstream side of the second registration roller pair 107 in the carrying direction (direction indicated by arrow A in the figure) of the recording medium 103 and that detects a timing for the recording medium 103 to arrive at the image forming part.

The image forming part is configured from a carrying belt 111, image forming units 112, light emitting diode (LED) heads 113, transfer rollers 115 and a fuser 114. At the image forming part, an image is formed on the recording medium 103 by an electrographic process by charging, exposure, development and fusion. Each of the image forming units 112, LED heads 113 and transfer rollers 115 is provided for each color of cyan (c), magenta (M), yellow (Y) and black (K. Because of the same configuration, the explanations are made below by applying the same reference numerals. Because the image forming units 112C, 112M, 112Y and 112K are consumable items, these are provided independently and removably from the printer 101.

The carrying belt 111 is an endless belt that extends between two rollers and that rotates to carry the recording medium 103 that has been supplied and carried, to a downstream of the image forming unit. The transfer roller 115 (115C, 115M, 115Y, 115K) is provided to face a photosensitive body, such as a photosensitive drum 116, across the carrying belt 111 and transfers a toner image formed on a surface of the photosensitive drum 116 onto the recording medium 103.

The LED head 113 (113C, 113M, 113Y, 113K) is an exposure part that irradiates light in accordance with print data and is attached to a openable and closable top cover part 102. The LED head 113 is separated from the surface of the photosensitive drum 116 when the top cover part 102 is opened. On the other hand, the LED head 113 approaches the surface of the photosensitive drum 116 when the top cover part 102 is closed so that exposure to the photosensitive drum 116 is achieved. Each LED head 113 is connected to a print controller 117 via a cable (not shown).

The image forming unit 112 (112C, 112M, 112Y, 112K) includes the photosensitive drum 116 as an image carrier. An electrostatic latent image that corresponds to image data is formed on the surface of the photosensitive drum 116 by exposing the surface of the photosensitive drum 116 by the LED head 113 in response to the image data after uniformly charging the surface of the photosensitive drum 116 by charging means (not shown). A first memory tag 118 (118C, 118M, 118Y, 118K) is attached to each image forming unit 112 and includes an integrated circuit (IC) chip and a nonvolatile memory. The first memory tag 118 allows wireless communication with the later discussed radio frequency (RF) reading/writing controller.

A toner cartridge 119 (119C, 119M, 119Y, 119K) stores toner as developer therein and is configured removably from the image forming unit 112. The toner cartridge 119 is configured to supply the toner stored therein to the inside of the image forming unit 112 when the toner cartridge 119 is attached to the image forming unit 112. A second memory tag 120 (120C, 120M, 120Y, 120K) is attached to each toner cartridge 119 and includes an integrated circuit (IC) chip and a nonvolatile memory. The second memory tag 120 allows wireless communication with the later discussed RF reading/writing controller.

The fuser 114 is provided on the downstream side of the carrying belt 111 in the carrying direction of the recording medium 103 and fixes the toner image transferred on the recording medium at the image forming part onto the recording medium by heat and pressure. An EXIT sensor 121 is a travelling system sensor that is provided on the downstream side of the fuser 114 in the carrying direction of the recording medium 103 and that detects ejection of the recording medium 103 from the fuser 114.

In addition, an ejection stacker 122 for stacking the ejected recording medium 103 is provided on the downstream side of the fuser 114 in the carrying direction of the recording medium 103. The controller 117 is configured from a central processing unit (CPU) as calculation means as well as control means, and storage means, such as a memory and the like and controls operation of the entire electrographic printer 101 based on control programs (software) stored in the storage means. Details of the printer controller 117 are described later.

Each of the above-described travelling system sensors (IN1 sensor 108, IN2 sensor 109, WR sensor 110 and EXIT sensor 121) is connected to the printer controller 117 via a cable. Information detected by each of the travelling system sensors is notified to the printer controller 117. Moreover, each roller (sheet supply roller 105, first registration roller pair 106, second registration roller pair 107, drive roller for carrying belt 111, and rollers for photosensitive drum 116, transfer roller 115 and fuser 114) is rotated and driven by a motor (not shown) and causes the recording medium 103 to be carried in a downward direction of the carrying direction indicated by arrow A in the figure.

The RF reading/writing controller 123 is connected to an antenna part 124 (124C, 124M, 124Y, 124K) and the printer controller 117 via a cable. Power and control signals are supplied from the printer controller 117 via the cable. The RF reading/writing controller 123 exchanges information with the printer controller 117 based on the control signals and performs a wireless communication control with the first memory tag 118 and the second memory tag 120 for reading and writing information.

The antenna part 124 is provided to face the first memory tag 118 and the second memory tag 120. A single antenna part 124 is configured capable of wirelessly communicating with a plurality of memory tags (first memory tag 118 and second memory tag 120) and of multi-reading, which reads out information stored in the plurality of memory tags.

An operational panel 125 is provided on a front upper part of the printer 101 and is connected to the printer controller 117 via a cable (not shown). The operational panel 125 includes a display part, such as a liquid crystal display (LCD) or the like, and an input part formed from a plurality of push button switches and the like. The operational panel 125 notifies the user of a variety of information by displaying a message and the like on the display part and accepts switch operation by the user using the input part to enter a variety of information, such as configuration information and the like. A low voltage power source 208 as a power source part receives power supplied from a commercial power source 10 and supplies power to the printer controller 117, the fuser 114 and drive sources for various motors and the like as power consumption parts.

In addition, in the printer 101, an optional tray 130, as an optional recording medium accommodation part that accommodates the recording medium 103, is provided below the recording medium accommodation part 104. A sheet supply roller 135 is provided above the optional tray 130. The sheet supply roller 135 rotates, separates and supplies each recording medium 103 accommodated in the optional tray 130 in the direction indicated by arrow A in the figure.

A third registration roller pair 136 is a carrying roller pair that pinches the recording medium 103 supplied by the sheet supply roller 135 and carries the recording medium 103 to the first registration roller pair 106. An IN1 sensor 138 is a travelling system sensor that is provided on the upstream side of the third registration roller pair 136 in the carrying direction (direction indicated by arrow A in the figure) of the recording medium 103 and that detects that the recording medium 103 has arrived. In the present embodiment, the explanation is made with a single optional tray 130 in the printer 101. However, the number of the optional trays is not limited to one, and a plurality of optional trays may be included.

Figure 1:
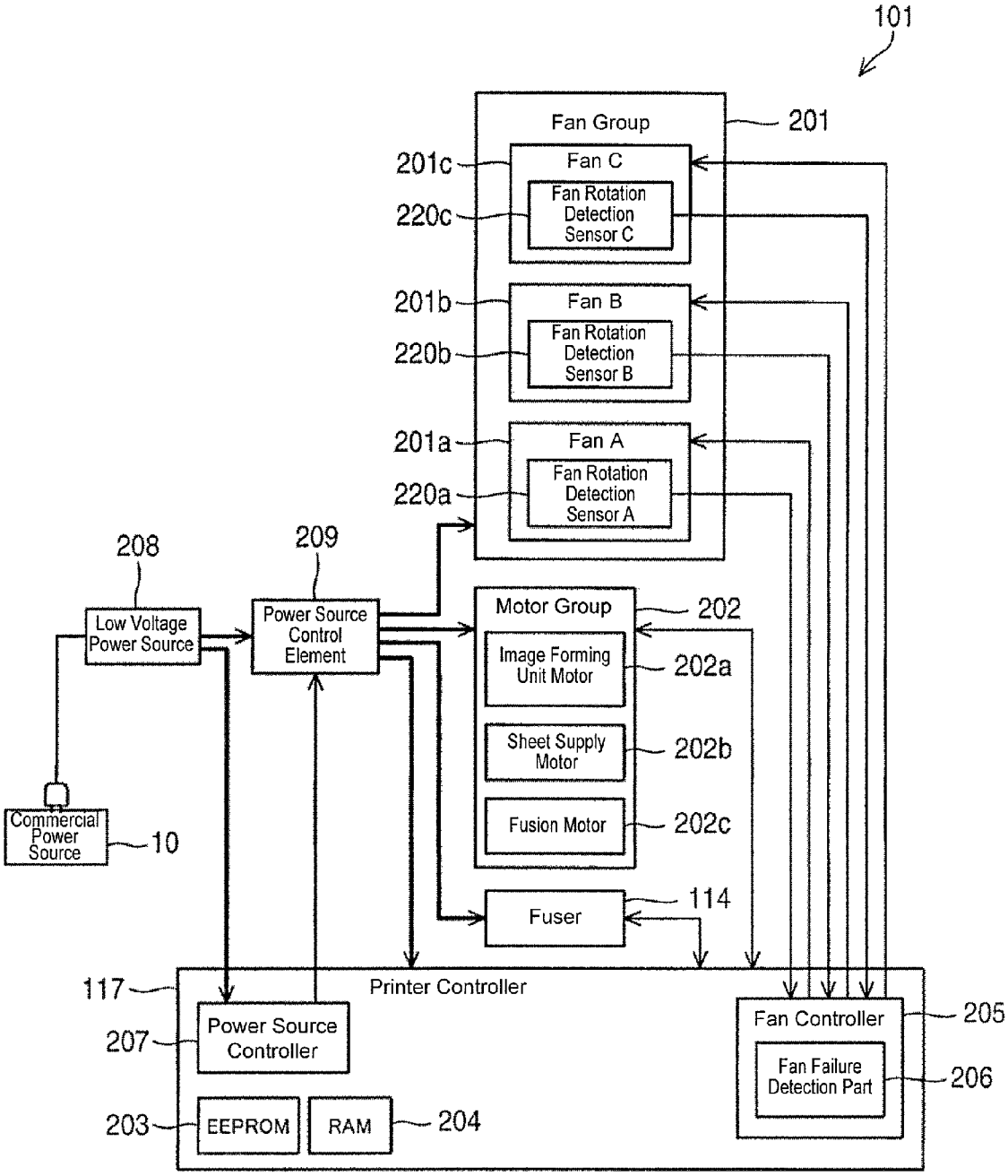
FIG. 1 is a block diagram illustrating a control configuration of an image forming device according to a first embodiment.

FIG. 1 is a block diagram illustrating a control configuration of an image forming device according to the first embodiment. In FIG. 1, thick arrows indicate power supply, and thin arrows indicate the flow of control signals. In the present embodiment, abnormal rotation of a fan, which functions as a cooling device that cools the power consumption part (heat generating part/portion) that generates heat upon receipt of power supply, is explained as an unrecoverable failure. The reason for explaining the abnormal rotation of the fan as an unrecoverable failure is that the abnormal rotation of the fan is one of failures that must be avoided for the device as it increases the temperature around the power consumption part (heat generating part/portion), causing expansion of malfunction to other parts in the device and an increase in time for repair and parts cost.

In addition, the unrecoverable failure is a failure where the part with abnormality does not operate due to the malfunction and where repair and/or replacement of the parts is necessary for recovery. In FIG. 1, the printer 101 is configured from a printer controller 117, a fan group 201, a motor group 202, a fuser 114, a low voltage power source 208, a power source control element 209, and the like.

The low voltage power source 208, which is an example of a first heat generating part, receives power supplied from the commercial power source 10 and, based on the power supply, supplies power to the printer controller 117 and the fan group 201, motor group 202, fuser 114, which is an example of a second heat generating part, and printer controller 117 via the power source control element 209, as power consumption parts. The first heat generating part is a part for which the power to elements other than the power controller is cut when an unrecoverable failure occurs at a fan that cools the first heat generating part. The second heat generating part is a part for which the print operation is shifted to an intermittent printing mode as a load reduction mode when an unrecoverable failure occurs at a fan that cools the second heat generating part.

Here, the printer controller 117, the fuser 114 and the motor group 202 correspond to the power consumption parts in the present application as the printer controller 117, the fuser 114 and the motor group 202 receive power supplied from the commercial power source 10. In addition, the fan group 201 is a cooling device group that cools a portion of the power consumption parts that requires cooling. The low voltage power source 208 is also included in the power consumption parts as the low voltage power source 208 receives power supplied from the commercial power source 10.

As described above, the printer controller 117 as the main controller controls the entire operation of the printer 101. The fan group 201, the motor group 202, a fan rotation detection sensor 220 and the fuser 114 are connected to the printer controller 117 via an input/output port. In addition, the RF reading/writing controller 123, the operational panel 125 and the travelling system sensors shown in FIG. 2 are connected to the printer controller 117.

The fan group 201 is configured from a fan A 201*a* (an example of a first cooling part) as a cooling device that cools the low voltage power source 208, a fan B 201*b* (an example of a second cooling part) as a cooling device that cools the fuser 114 and a fan C 201*c* (an example of a third cooling part) as a cooling device that cools the printer controller 117. The fan A 201*a*, the fan B 201*b* and the fan C 201*c* are connected to the input/output port of the printer controller 117. The first cooling part is in correspondence with the first heat generating part. The second cooling part is in correspondence with the second heat generating part. The third cooling part is correspondence with the main controller.

Therefore, the fan A 201*a*, the fan B 201*b* and the fan C 201*c* cool the low voltage power source 208, and the fuser 114 and the printer controller 117 that receive the supply of power from the low voltage power source 208. In the present embodiment, the explanation is made with a case where the fans are attached to the low voltage power source 208, fuser 114 and printer controller 117 as an example. However, the configuration is not limited to this, and the fans may be attached to other power consumption parts to which the power is supplied.

In addition, A fan rotation detection sensor 220*a* that detects rotation of the fan A 201*a* is provided in the fan A 201*a*. A fan rotation detection sensor 220*b* that detects rotation of the fan B 201*b* is provided in the fan B 201*b*. A fan rotation detection sensor 220*c* that detects rotation of the fan C 201*c* is provided in the fan C 201*c*. The fan rotation detection sensors 220*a*, 220*b* and 220*c* are connected to the input/output port of the printer controller 117.

The motor group 202 is configured from an image forming unit motor 202*a* that rotates and drives each roller, such as the photosensitive drum 116 shown in FIG. 2, in the image forming unit 112, a sheet supply motor 202*b* that rotates and drives each roller, such as the sheet supply roller 105, the sheet supply roller 135, the first registration roller pair 106, the second registration roller pair 107, the third registration roller pair 136 or the like on the medium carrying path, and a fusion motor 202*c* that rotates and drives rollers in the fuser 114. The image forming unit motor 202*a*, the sheet supply motor 202*b* and the fusion motor 202*c* are connected to the input/output port of the printer controller 117.

The printer controller 117 (main controller) includes an electrical erasable and programmable read only memory (EEPROM) 203, a random access memory 204 that is a volatile memory for temporary storage, a fan controller 205 that controls the fan group 201, a fan failure detection part 206 (failure detection part) that detects the failure in the fan group 201, and a power source controller 207 that controls power supply to the fan group 201, the motor group 202 and the fuser 114. The printer controller 117 includes a drive circuit for controlling operation of the fan group 201, the motor group 202 and the fuser 114 and is cooled by the fan C 201*c* as the printer controller 117 generates heat due to the power supplied from the low voltage power source 208.

Using the fan failure detection part 206, the fan controller 205 detects failures occurred at the fan A 201*a*, fan B 201*b* and fan C 201*c* of the fan group 201 based on input signals from the fan rotation detection sensors 220*a*, 220*b* and 220*c*. The fan controller 205 also rotates, and stops rotation of, the fan A 201*a*, fan B 201*b* and fan C 201*c* of the fan group 201 based on the detected failure condition.

The fan rotation detection sensor 220*a* is included in the fan A 201*a*, the fan rotation detection sensor 220*b* is included in the fan B 201*b*, and the fan rotation detection sensor 220*c* is included in the fan C 201*c*. The fan rotation detection sensors 220*a*, 220*b* and 220*c* each notify the rotation and stop of the respective fans to the fan controller 205. The fan rotation detection sensors 220*a*, 220*b* and 220*c* are each configured from an optical sensor formed from a light emitting element and a light receiving element that receives light emitted from the light emitting element, for example, and an encoder provided on a rotational shaft of the respective fan A 201*a*, fan B 201*b* and fan C 201*c* and positioned to block an optical axis of the optical sensor, and the like, to detect the rotation of the respective fans by the optical sensor.

The fan failure detection part 206 of the fan controller 205 detects that a failure (abnormality) has occurred at a fan when information from any of the fan rotation detection sensors 220*a*, 220*b* and 220*c* indicates that the rotation of the corresponding fan A 201*a*, fan B 201*b* and fan C 201*c* is in stop despite the fan A 201*a*, fan B 201*b* and fan C 201*c* are controlled to rotate. As described above, the fan failure detection part 206 functions as a failure detection part that detects an unrecoverable failure at each power consumption part.

A power source controller 207 receives power supply directly from the low voltage power source 208 and switches the supply and termination of the power from and to the fan group 201, the motor group 202, the fuser 114, an operation panel (not shown) and the printer controller 117 by controlling the power source control element 209. The power source control element 209 is connected to the power source controller 207 and switches the supply of power and termination of power supply to the fan group 201, the motor group 202, the fuser 114, an operation panel (not shown) and the printer controller 117 in accordance with a control signal from the power source control element 207.

When the fan failure detection part 206 of the fan controller 205 detects a failure at the fan A 201*a*, fan B 201*b* or fan C 201*c*, the printer controller 117 shifts to a load reduction mode under which an amount of power supplied to the power consumption part (low voltage power source 208, fuser 114, printer controller 117) that the fan with the failure cools (i.e., an amount of power consumed by the powers consumption part per predetermined time), by controlling the power source controller 207, the power source control element 209, the motor group 202, the fuser 114 and the like, thereby controlling the temperature increase at the power consumption part.

Here, the load reduction mode is a mode to perform a print operation in which the temperature increase at the power consumption part that the fan with the failure cools, is controlled by suppressing power supply to the power consumption part. For example, if a failure occurs at a fan for the fuser 114, the amount of power supplied to the fuser 114 per predetermined time is suppressed by extending the time intervals for fusion operation. If a failure occurs at the fan for the printer controller 117, the amount of power supplied to the printer controller 117 per predetermined time is suppressed by extending the time intervals between print operations. If a failure occurs at the fan for the low voltage power source 208, the amount of power supplied from the commercial power source 10 to the low voltage power source 208 is suppressed by terminating the power supplied to parts other than the power source controller 207, such as the fuser 114, the motor group 202 and the like.

The load indicates the power. A large load means that the amount of power supplied to each power consumption part while the power consumption part is operated is greater than the amount when the power consumption part is not being operated. By reducing the load to each of the power consumption parts, the temperature increase at the power consumption parts is suppressed.

Table 1 is a table describing an operation under a first load reduction mode (load reduction mode 1) performed by the printer controller 117 that detects a fan failure. Table 1 is stored in an EEPROM 203 of the printer controller 117 as a data table.

TABLE 1

| Fan with Failure | Use of Fan | Operation at Time of Fan Failure | Purpose of Operation at Time of Fan Failure |
|---|---|---|---|
| Fan A 201a | Cooling Low Voltage Power Source | Cutting Power for Elements Other Than Power Source Controller | Reduction of Load at Low Voltage Power Source |
| Fan B 201b | Cooling Fuser | Intermittent Printing | Reduction of Load at Fuser |
| Fan C 201c | Cooling Controller | Intermittent Printing | Reduction of Load at Controller |

Table 2 is a table describing an operation under a second load reduction mode (load reduction mode 2), which is different from the first load reduction mode and is performed by the printer controller 117 that detects a fan failure. Table 2 is stored in the EEPROM 203 of the printer controller 117 as a data table.

TABLE 2

| Fan with Failure | Use of Fan | Operation at Time of Fan Failure | Purpose of Operation at Time of Fan Failure |
|---|---|---|---|
| Fan A 201a | Cooling Low Voltage Power Source | Cutting Power for Elements Other Than Power Source Controller | Reduction of Load at Low Voltage Power Source |
| Fan B 201b | Cooling Fuser | Intermittent Printing | Reduction of Load at Fuser |
| Fan C 201c | Cooling Controller | Suspension of Sheet Supply from Optional Tray | Reduction of Load at Controller |

The difference between the operation under the first load reduction mode shown in Table 1 and the operation under the second load reduction mode shown in Table 2 is that, when a failure occurs at the fan C 201*c*, the printing is performed intermittently under the first load reduction mode, while the sheet supply from an optional tray is suspended under the second load reduction mode.

Figure 3A:
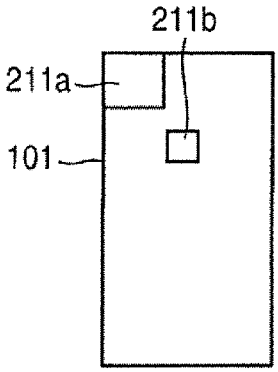
FIGS. 3A to 3D are explanatory diagrams illustrating mounting locations and cooling areas of fans according to the first embodiment.
Figure 3B:
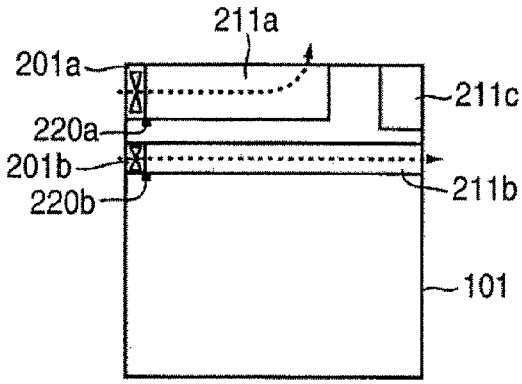
Figure 3C:
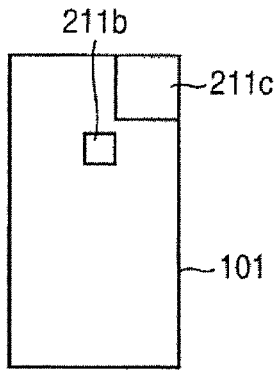
Figure 3D:
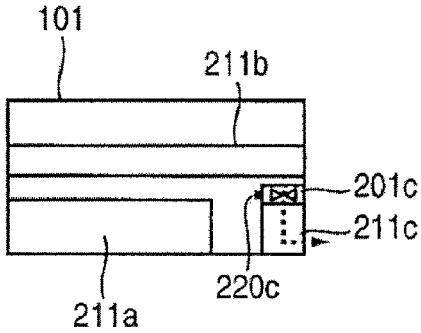
Figure 4A:
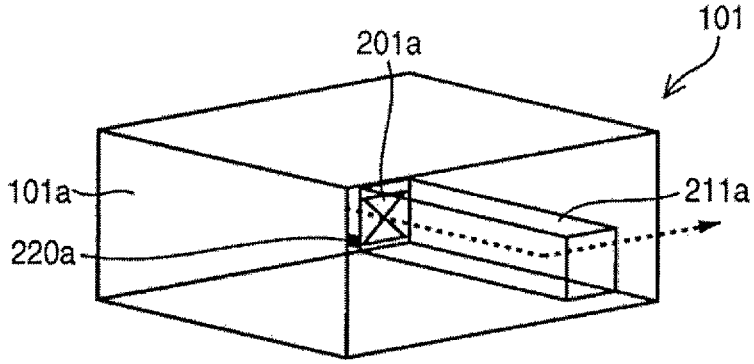
FIGS. 4A to 4C are perspective views illustrating the mounting locations and the cooling areas of the fans according to the first embodiment.
Figure 4B:
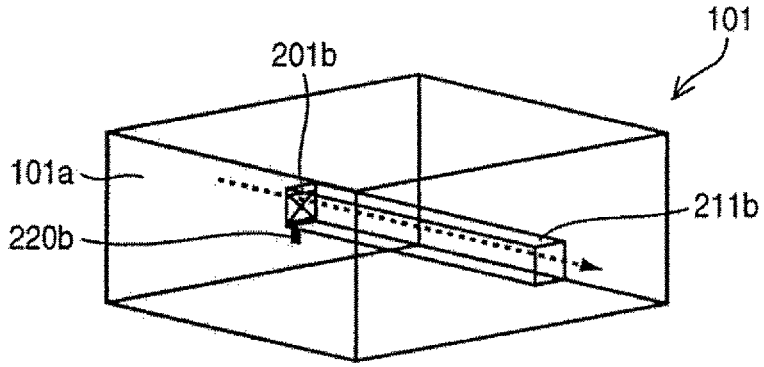
Figure 4C:
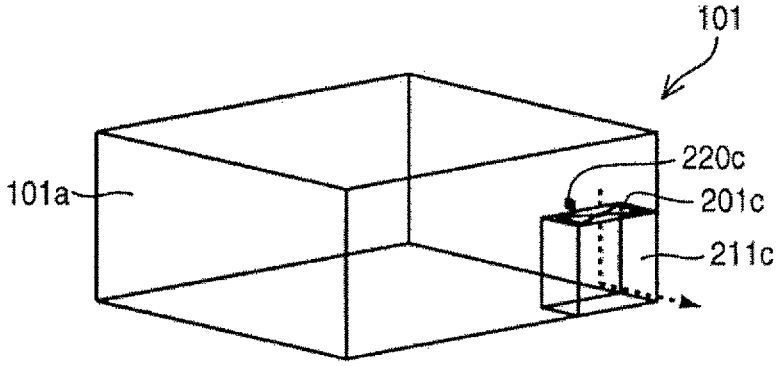

FIGS. 3A to 3D are explanatory diagrams illustrating mounting locations and cooling areas of fans according to the first embodiment. FIGS. 4A to 4C are perspective views illustrating the mounting locations and the cooling areas of the fans according to the first embodiment. FIG. 3A is a cross-sectional view of the printer 101 from a left side surface. FIG. 3B is a cross-sectional view of the printer 101 from the top surface. FIG. 3C is a cross-sectional view of the printer 101 from a right side surface. FIG. 3D is a cross-sectional view of the printer from the front surface. In addition, the left side surface in FIGS. 4A to 4C is the front surface 101*a* of the printer 101. Moreover, for ease of explanation, FIGS. 3A to 3D and 4A to 4C schematically show the shape of the printer 101 as a rectangular parallelepiped.

In FIGS. 3A to 3D and 4A to 4C, the reference numeral 211*a* indicates a cooling area (space) by the fan A 201*a*, the reference numeral 211*b* indicates a cooling area (space) by the fan B 201*b*, and the reference numeral 211*c* indicates a cooling area (space) by the fan C 201*c*.

The fan A 201*a* cools a wide area of the lower part of the rear part of the printer 101 for cooling the low voltage power source. The fan B 201*b* cools a wide area of the middle part of the center part of the printer 101 in the front-rear direction for cooling the fuser. The fan C 201*c* cools the right side area of the lower part of the rear part of the printer 101 for cooling the printer controller. Broken arrows in FIGS. 3A to 3D and 4A to 4C indicate the flow of cooling air by the fans.

In addition, the fan A 201*a* includes the fan rotation detection sensor 220*a* therein. The fan B 201*b* includes the fan rotation detection sensor 220*b* therein. The fan C 201*c* includes the fan rotation detection sensor 220*c* therein. The fan rotation detection sensors 220*a*, 220*b* and 220*c* notify the rotation state of the respective fans to the fan controller 205 shown in FIG. 1. The fan controller 205 detects abnormality of each fan based on the information provided by the fan rotation detection sensors 220*a*, 220*b* and 220*c*.

Operation of the above-described configuration is explained. A print operation of the printer is first explained based on FIG. 2. In accordance with a print instruction received from a host device, such as a personal computer or the like, the printer controller 117 of the printer 101 prints an image on the recording medium 103 by performing a generation process for image data instructed for printing, a sheet supply and carrying control for the recording medium 103 accommodated in the recording medium accommodation part 104 and the optional tray 130, a development control for forming a developer image by the image forming unit 112, a transfer control for transferring the developer image onto the recording medium 103 by the transfer roller 115, and a fusion control for fixing the transferred developer image onto the recording medium 103 by heat and pressure by the fuser 114.

Figure 5:
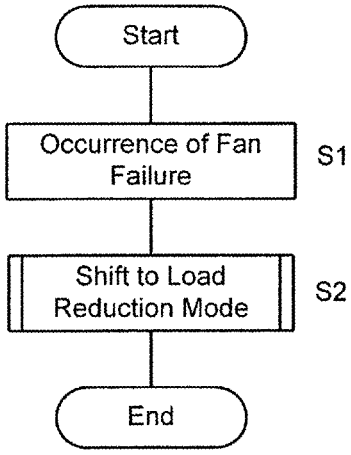
FIG. 5 is a flow diagram illustrating a process for transition to a load reduction mode according to the first embodiment.

Next, a process in which the printer controller shifts from a normal mode to the load reduction mode is explained based on steps represented by "S" in a flow diagram in FIG. 5 that illustrates a process for transition to a load reduction mode according to the first embodiment, with reference to FIG. 1.

S1: When an abnormality occurs in fan rotation as a failure at the fan A 201*a*, the fan B 201*b* or the fan C 201*c*, the corresponding fan rotation sensor 220*a*, 220*b* or 220*c* detects the abnormality at the fan A 201*a*, the fan B 201*b* or the fan C 201*c* and notify the abnormality to the fan controller 205 of the printer controller 117.

S2: The fan failure detection part 206 of the fan controller 205 detects the failure of the fan based on the signal notified from the fan rotation detection sensor 220*a*, 220*b* or 220*c*, and the printer controller 117 shifts to the load reduction mode in accordance with a data table stored in the EEPROM 203. Here, details of the process for moving to the load reduction mode are explained with reference to FIGS. 1, 3A to 3D and 4A to 4C, and Tables 1 and 2. Tables 1 and 2 show two operational examples. However, the process is not limited to these operational examples.

First, a process that takes place when a failure of the fan A 201*a* is detected is explained. The fan A 201*a* cools the low voltage power supply 208. The low voltage power supply 208 supplies power to the entire printer 101. If the print operation is continuously performed even after the rotation of the fan A 201*a* stops due to a failure occurred at the fan A 201*a*, the low voltage power source 208 may malfunction because the low voltage power source 208 is not cooled, causing a temperature increase. This may result in the failure spreading through the entire printer 101.

Therefore, if the failure occurs at the fan A 201*a* (i.e., if the fan A 201*a* stops), the power source controller 207 of the printer controller 117 controls the power source control element 209 to stop operation of the printer 101 by cutting the power supply to various elements (power consumption parts) of the printer controller 117, the fan group 201, the motor group 202 and the fuser 114, except the power source controller 207. As a result, the load of the low voltage power source 208 is reduced, and thereby the temperature increase at the low voltage power source 208 is controlled.

Next, a process that takes place when a failure of the fan B 201*b* is detected is explained. The fan B 201*b* cools the fuser 114. In the fuser 114, a halogen lamp as a heat source and rollers are driven and controlled by the printer controller 117. If the print operation is continuously performed even after the rotation of the fan B 201*b* stops due to the failure occurred at the fan B 201*b*, the fuser 114 may malfunction because of the heat generated by the fuser 114 itself, and the inside of the housing of the printer 101 may deform due to the temperature increase around the fuser 114. As a result, a failure may occur that the print operation for the recording medium 103 is not normally performed. Therefore, if the failure occurs at the fan B 201*b* (i.e., if the fan B 201*b* stops), the printer controller 117 controls the motor group 202 and the fuser 114 and shifts to an intermittent printing mode as the load reduction mode.

The intermittent printing is a print operation in which time intervals for the print operation for each recording medium are maintained longer than the normal print operation during which the fan failure detection part 206 does not detect the failure occurred at the fan B 201*b* that cools the fuser 114 (e.g., a print operation that repeats the printing of two recording media and a 30-second pause, rather than the normal print operation to continuously print a requested number of recording media), which is an operation intended to lower the temperature of the fuser 114 by intermittently performing sheet supply and carrying operations of the recording medium 103 from the recording sheet accommodation part 104 and the optional tray 130, the heat application operation by the fuser 114 and the rotating and driving of the rollers in the fuser 114. Here, the time intervals that are configured longer than the time intervals during the normal print operation are referred to as extended time intervals.

Moreover, even if a failure occurs at the fan B 201*b* (even if the fan B 201*b* stops), the temperature of the fuser 114 immediately after the occurrence of the failure has not reached to a temperature at which the fuser 114 malfunctions. Therefore, by changing the print operation to the intermittent printing after the occurrence of the failure, the temperature increase of the fuser 114 is suppressed, thereby allowing the print operation to continue. As discussed above, when the fan failure detection part 206 detects that a failure has occurred at the fan B 201*b* that cools the fuser 114, the load to the fuser 114 is reduced by extending the time intervals for the fuser operation by the fuser 114 longer than when the fan failure detection part 206 does not detect the failure occurred at the fan B 201*b* that cools the fuser 114, thereby allowing the temperature increase around the fuser 114 to be controlled.

Next, a process that takes place when a failure of the fan C 201*c* is detected is explained. The fan C 201*c* cools the printer controller 117. The printer controller 117 performs overall control of each part (element) of the printer 101. If the print operation is continuously performed even after the rotation of the fan C 201*c* stops due to the failure occurred at the fan C 201*c*, a failure may occur in which the printer controller 117 malfunctions due to the heat generated by the printer controller 117 itself if the print operation is continuously performed thereafter (e.g., continuous operation under a large load at carrying motors and the like, such as supplying sheets from the optional tray 130 and the like as shown in FIG. 2). Therefore, when a failure occurs at the fan C 201*c* (even if the fan C 201*c* stops), the printer controller 117 controls the motor group 202 and the fuser 114 and shifts to the above-described intermittent printing mode.

As discussed above, when the fan failure detection part 206 detects that a failure has occurred at the fan C 201*c* that cools the printer controller 117, the load to the printer controller 117 is reduced by extending the time intervals for the print operation performed by the printer controller 117 longer than when the fan failure detection part 206 does not detect the failure occurred at the fan C 201*c* that cools the printer controller 117, that is, by moving in to the intermittent printing mode in which the sheet supply and carrying operation for the recording media 103 from the recording medium accommodation part 104 and the optional tray 130, the heat application operation by the fuser 114 and the rotation and driving of rollers are intermittently performed, thereby allowing the temperature increase around the printer controller 117 to be controlled.

Moreover, as shown in Table 2, the printer controller 117 may suspend the sheet supply from the optional tray 130 (secondary medium accommodation part) shown in FIG. 2 by controlling the motor group 202 and may supply sheets only from the recording medium accommodation part 104. The reasons for suspending the sheet supply from the optional tray 130 shown in FIG. 2 is because the sheet supply from the optional tray 130 causes an increase in the number of carrying rollers driven by the third registration roller pair 136 and the like, which causes an increase in power supplied to the printer controller 117 and thereby an increase in the temperature around the printer controller 117.

By suspending the sheet supply from the optional tray 130 shown in FIG. 2, the load to the printer controller 117 is reduced, thereby controlling the temperature increase around the printer controller 117. Moreover, even if a failure occurs at the fan C 201*c* (even if the fan C 201*c* stops), the temperature of the printer controller 117 immediately after the occurrence of the failure has not reached to a temperature at which the fuser 114 malfunctions. Therefore, by moving the print operation after the occurrence of the failure to the intermittent printing and by suspending the sheet supply from the optional tray, the temperature increase of the printer controller 117 is suppressed, thereby allowing the print operation to continue.

Further, the selection as to moving to the intermittent printing mode or suspending the sheet supply from the optional tray 1 is to be determined by information stored in the EEPROM 203. The information is set by a configuration operation by the user using the operational panel or an instruction from the host device. Furthermore, when the failure occurred at the fan is solved by repair or replacement of parts, the normal mode in which the normal continuous print operation is performed is recovered.

If the fan failure detection part 206 detects a unrecoverable failure at a fan and that requires repair or replacement of parts, the printer controller 117 suppresses the power supplied to the power consumption parts using the power source controller 207 in response to the failed fan (fan A 201*a*, fan B 201*b*, fan C 201*c*) and shifts to the load reduction mode in which the temperature increase is controlled by reducing the load at the power consumption parts (heat generating parts). This allows the printer 101 to be used at a level where the failure does not further expand. In addition, this avoid a situation where the printer 101 cannot be used after the detection of failure at any of the fan group 201 (fan A 201*a*, fan B 201*b*, fan C 201*c*), allowing the convenience to be secured for the user.

As explained above, according to the first embodiment, if an unrecoverable failure that requires repair or replacement of parts occurs at a fan, the printer controller shifts to the load reduction mode in which the temperature increase is controlled by reducing the load at the power consumption parts (heat generating parts). Therefore, there are advantages that the printer can be used at a level at which the failure does not further expand, and the convenience is secured for the user.

Second Embodiment

In contrast to the configuration of the first embodiment, a second embodiment has a configuration in which a duct that connects the cooling area of the fan A and the cooling area of the fan B and a shield plate between the duct and the cooling area of the fan B are provided. The configuration of the second embodiment is explained based on FIGS. 6A to 6D which are explanatory diagrams illustrating the mounting location and the cooling area of the fan according to the second embodiment, FIGS. 7A and 7B which are perspective views illustrating the mounting location and the cooling area of the fan according to the second embodiment, and FIG. 8 which is a block diagram illustrating the control configuration of the image forming device according to the second embodiment. Explanation of parts that are the same as those in the above-described first embodiment is omitted by applying the same symbols.

Figure 6A:
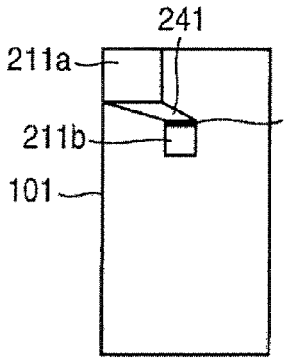
FIGS. 6A to 6D are explanatory diagrams illustrating the mounting locations and the cooling areas of the fans according to a second embodiment.
Figure 6B:
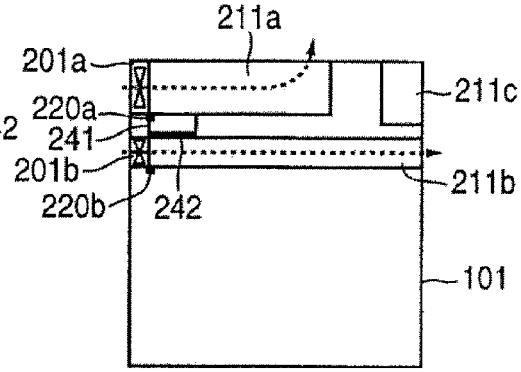
Figure 6C:
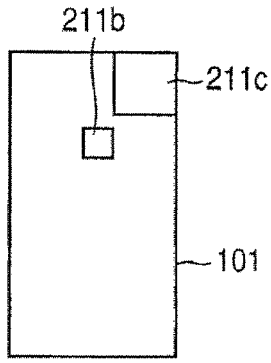
Figure 6D:
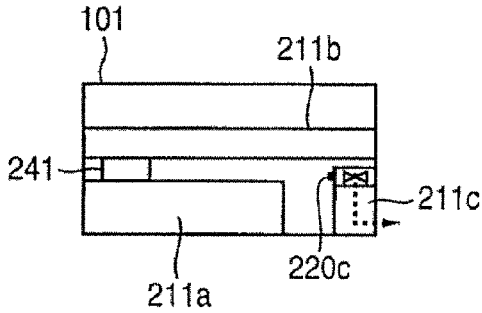
Figure 7A:
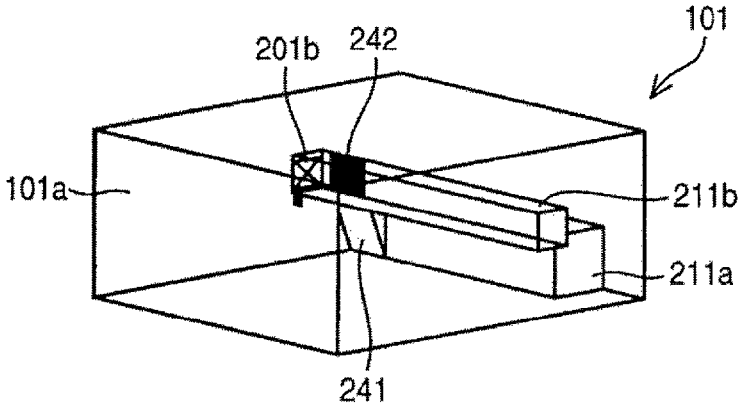
FIGS. 7A and 7B are perspective views illustrating the mounting locations and the cooling areas of the fans according to the second embodiment.
Figure 7B:
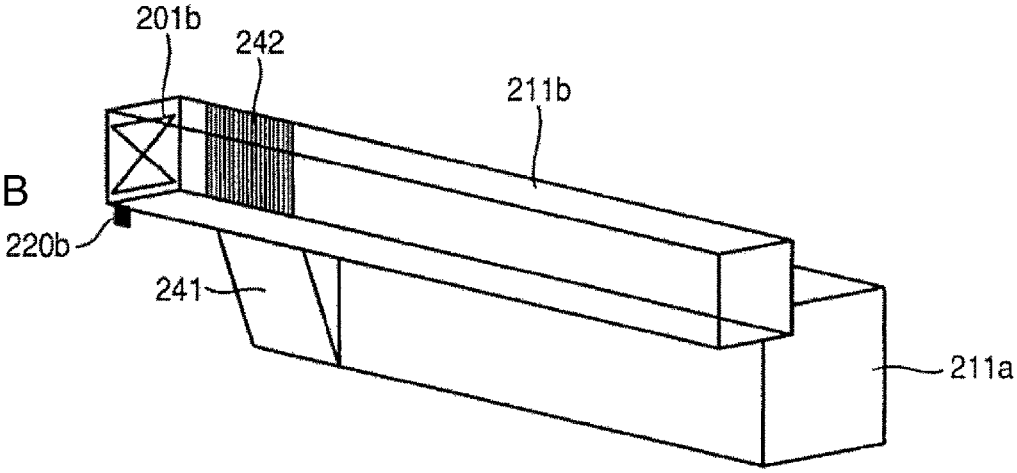

FIG. 6A is a cross-sectional view of the printer 101 from a left side surface. FIG. 6B is a cross-sectional view of the printer 101 from the top surface. FIG. 6C is a cross-sectional view of the printer 101 from a right side surface. FIG. 6D is a cross-sectional view of the printer from the front surface. The left side surface in FIG. 7A is the front surface 101*a* of the printer 101, and FIG. 7B is an enlarged view of a main part of FIG. 7A. Moreover, for ease of explanation, FIGS. 6A to 6D and 7A and 7B schematically show the shape of the printer 101 as a rectangular parallelepiped. Broken arrows in FIGS. 6A to 6D indicate flow of cooling air by the fans.

In FIGS. 6A to 6D, 7A and 7B, a duct 241 is provided as a tubular connection member between the cooling area 211*a* by the fan A 201*a* and the cooling area 211*b* by the fan B 201*b* to connect the cooling area 211*a* and the cooling area 211*b*. There is no limitation regarding the inner and outer shapes of the connection member. As long as the connection member includes a hollow shape through which air flows, a cross-sectional shape of the connection member may be circular, oval, square, rectangular and the like.

In addition, between the duct 241 and the cooling area 211*b*, an isolation plate 242 is provided that is configured openably and closeably by a drive part, such as a solenoid or the like (not shown). By opening the isolation plate 242, cooling air flows from the cooling area 211*b* to the cooling area 211*a*, and by closing the isolation plate 242, the cooling area 211*a* and the cooling area 211*b* are isolated from each other, forming independent cooling areas.

Figure 8:
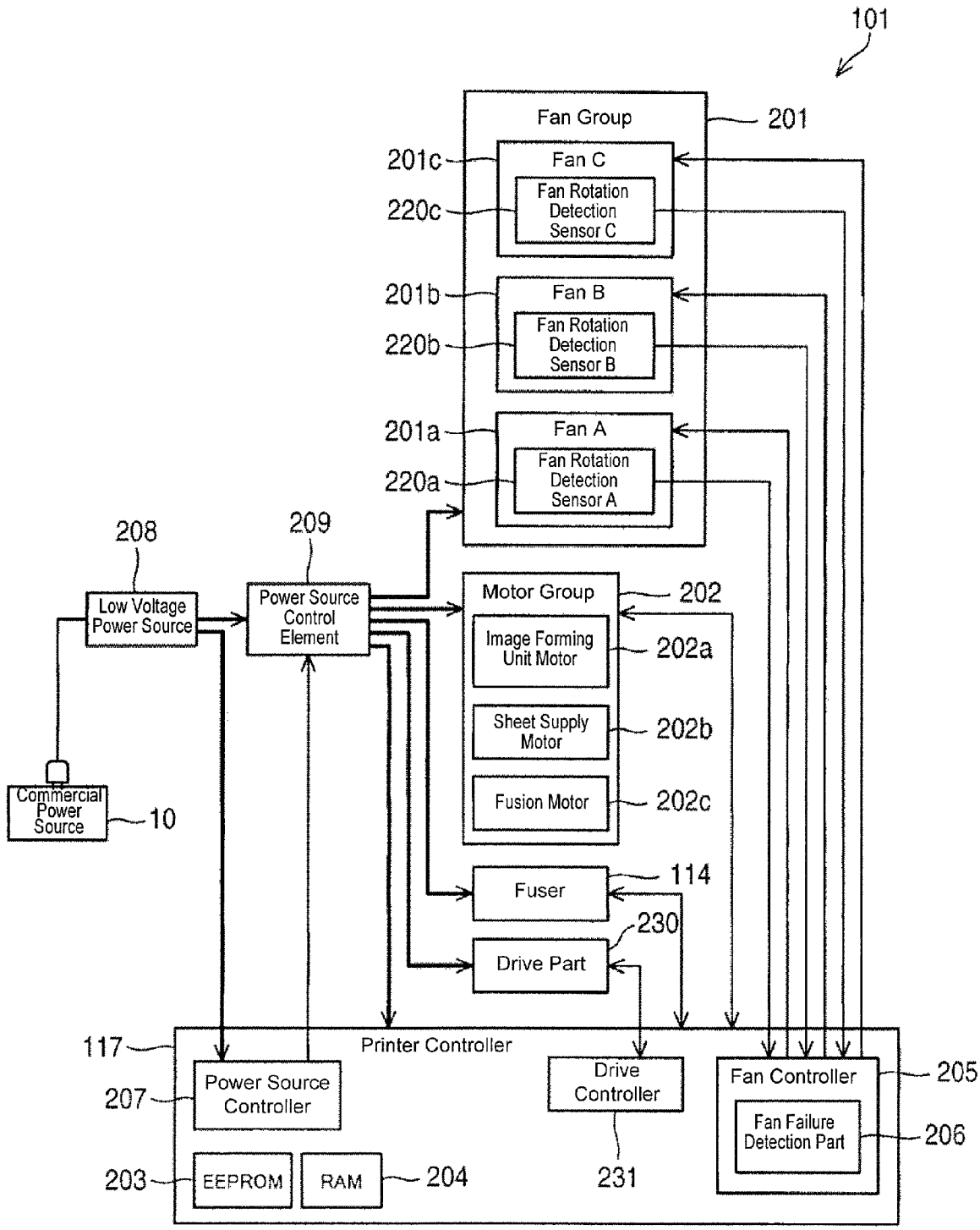
FIG. 8 is a block diagram illustrating the control configuration of the image forming device according to the second embodiment.

In FIG. 8, a drive part 230 that is configured by a solenoid or the like drives to open and close the isolation plate 242 shown in FIGS. 6A to 6D, 7A and 7B. The drive part 230 is connected to the power source control element 209 and receives power supplied from the power supply controller element 209. In addition, the drive part 230 is connected to the drive controller 231 of the printer controller 117 and performs opening and closing operations for the isolation plate 242 based on a control signal from the drive controller 231.

Table 3 is a table describing an operation under a third load reduction mode (load reduction mode 3) performed by the printer controller 117 that detects a fan failure. Table 3 is stored in an EEPROM 203 of the printer controller 117 as a data table.

The difference between the operation under the third load reduction mode shown in Table 3 and the operation under the fourth load reduction mode shown in Table 4 is that, when a failure occurs at the fan C 201*c*, the printing is performed intermittently under the third load reduction mode, while the sheet supply from an optional tray is suspended under the fourth load reduction mode, similar to the first embodiment.

Operation of the above-described configuration is explained. Print operation of the printer is the same as the first embodiment. Therefore, explanation is omitted. A process for moving to the load reduction mode in the second embodiment is the same as S1 and S2 in the flow diagram of FIG. 5 that indicates the process for moving to the load reduction mode in the first embodiment. Therefore, explanation is omitted. Details of the process for moving to the load reduction mode are explained with reference to FIGS. 6A to 6D, 7A, 7B and 8 and Tables 3 and 4. Tables 3 and 4 show two operational examples. However, the process is not limited to these operational examples.

First, a process that takes place when a failure of the fan A 201*a* is detected is explained. Similar to the first embodiment, the fan A 201*a* cools the low voltage power supply 208. The low voltage power supply 208 supplies power to the entire printer 101. If the print operation is continuously performed even after the rotation of the fan A 201*a* stops due to a failure occurring at the fan A 201*a*, the low voltage power source 208 may malfunction because the low voltage power source 208 is not cooled, causing a temperature increase. This may result in the failure to spread through the entire printer 101.

Therefore, if the failure occurs at the fan A 201*a* (i.e., if the fan A 201*a* stops), the drive controller 231 of the printer controller 117 opens the isolation plate 242 that isolates the cooling area 211*b* and the duct 241 using the drive part 230 and releases the isolation. As a result, cooling air by the fan B 201*b* flows into the cooling area 211*b* of the fan A 201*a*, thereby temporarily cooling the low voltage power source 208. That is, the low voltage power source 208 is cooled by

TABLE 3

| Fan with Failure | Use of Fan | Operation 1 at the time of fan failure | Operation 2 at the time of fan failure | Purpose of Operation at Time of Fan Failure |
|---|---|---|---|---|
| Fan A 201a | Cooling Low Voltage Power Source | Driving Solenoid (Changing Flow of Cooling Air) | → Intermittent Printing | Reduction of Load at Low Voltage Power Source and Cooling Low Voltage Power Source by Fan B 201b |
| Fan B 201b | Cooling Fuser | Driving Solenoid (Changing Flow of Cooling Air) | → Intermittent Printing | Reduction of Load at Fuser and Cooling Fuser by Fan A 201a |
| Fan C 201c | Cooling Controller | Intermittent Printing | — | Reduction of Load at Controller |

Table 4 is a table describing an operation under a fourth load reduction mode (load reduction mode 4), which is different from the third load reduction mode and is performed by the printer controller 117 that detects a fan failure. Table 4 is stored in the EEPROM 203 of the printer controller 117 as a data table.

TABLE 4

| Fan with Failure | Use of Fan | Operation 1 at Time of Fan Failure | Operation 2 at Time of Fan Failure | Purpose of Operation at Time of Fan Failure |
|---|---|---|---|---|
| Fan A 201a | Cooling Low Voltage Power Source | Driving Solenoid (Changing Flow of Cooling Air) | → Suspension of Sheet Supply From Optional Tray | Reduction of Load at Low Voltage Power Source and Cooling Low Voltage Power Source by Fan B 201b |
| Fan B 201b | Cooling Fuser | Driving Solenoid (Changing Flow of Cooling Air) | → Intermittent Printing | Reduction of Load at Fuser and Cooling Fuser by Fan A 201a |
| Fan C 201c | Cooling Controller | Suspension of Sheet Supply from Optional Tray | — | Reduction of Load at Controller |

changing the cooling device. Here, the cooling device is not necessarily the fan itself but a cooling device in a broader sense that includes a cooling area through which the cooling air flows.

Moreover, as shown in Table 3, the printer controller 117 shifts to the intermittent printing mode by controlling the motor group 202 and the fuser 114. In addition, as shown in FIG. 4, the printer controller 117 suspends the sheet supply from the optional tray by controlling the motor group 202. As a result, the load of the low voltage power source 208 is reduced, and thereby the temperature increase at the low voltage power source 208 is controlled.

Further, similar to the first embodiment, the selection as to moving to the intermittent printing mode or suspending the sheet supply from the optional tray 1 is to be determined by information stored in the EEPROM 203. The information is set by a configuration operation by the user using the operational panel or an instruction from the host device.

As described above, if the failure occurs at the fan A 201*a* (i.e., if the fan A 201*a* stops), the drive controller 231 of the printer controller 117 opens the isolation plate 242 that isolates the cooling area 211*b* and the duct 241 using the drive part 230. As a result, cooling air by the fan B 201*b* flows into the cooling area 211*b* of the fan A 201*a*, thereby temporarily cooling the low voltage power source 208. Moreover, the load of the low voltage power source 208 is reduced, and thereby the temperature increase at the low voltage power source 208 is controlled.

Next, a process that takes place when a failure of the fan B 201*b* is detected is explained. Similar to the first embodiment, the fan B 201*b* cools the fuser 114. In the fuser 114, a halogen lamp as a heat source and rollers are driven and controlled by the printer controller 117. If the print operation is continuously performed even after the rotation of the fan B 201*b* stops due to the failure occurred at the fan B 201*b*, the fuser 114 may malfunction because of the heat generated by the fuser 114 itself, and the inside of the housing of the printer 101 may deform due to the temperature increase around the fuser 114. As a result, a failure may occur that the print operation for the recording medium 103 is not normally performed.

Therefore, if the failure occurs at the fan B 201*a* (i.e., if the fan A 201*a* stops), the drive controller 231 of the printer controller 117 opens the isolation plate 242 that isolates the cooling area 211*b* and the duct 241 using the drive part 230 and releases the isolation. As a result, cooling air by the fan A 201*a* flows into the cooling area 211*b* of the fan B 201*b*, thereby temporarily cooling the fuser 114. That is, the fuser 114 is cooled by changing the cooling device.

Moreover, the printer controller 117 controls the motor group 202 and the fuser 114 and shifts to the intermittent printing mode. As a result, the load of the fuser 114 is reduced, and thereby the temperature increase at the fuser 114 is controlled. The process that takes places when the fan C 201*c* detects a failure is the same as the first embodiment. Therefore, explanation is omitted.

As described above, when a failure is detected at the fan A 201*a*, by opening the isolation plate 242 to allow the cooling air by the fan B 201*b* to flow into the cooling area 211*a* of the fan A 201*a*, the usable range of the printer can be expanded to a level to perform the intermittent printing, without stopping the print operation by the printer 101 by cutting the power supply to each of the printer controller 117, the fan group 201, the motor group 202 and the fuser 114 except the power source controller 207. As a result, the user's convenience is improved more than the first embodiment.

Moreover, when a failure is detected at the fan B 201*b*, by opening the isolation plate 242 to allow the cooling air by the fan A 201*a* to flow into the cooling are 211*b* of the fan B 201*b*, the printing can be performed at a pause for printing under the intermitting printing that is shorter than 30 seconds (e.g., 15 seconds). Therefore, the user's convenience is improved more than the first embodiment.

As described above, in the second embodiment, when a failure is detected at the fan A, by opening the isolation plate to allow the cooling air by the fan B to flow into the cooling area of the fan A, the usable range of the printer can be expanded to a level to perform the intermittent printing, without stopping the print operation by the printer. Therefore, there is an advantage in that the user's convenience is improved.

In addition, when a failure is detected at the fan B, by opening the isolation plate to allow the cooling air by the fan A to flow into the cooling are of the fan B, the printing can be performed at a pause for printing under the intermitting printing that is shorter than 30 seconds (e.g., 15 seconds). Therefore, there is an advantage that the user's convenience is improved more than the first embodiment.

The first and second embodiments are explained with an example in which the first and second embodiments are applied in a printer as an image forming device. However, such application is not limited to the printer but may be made in office automation devices, such as a photocopy machine, a facsimile machine, a multi function peripherals and the like that have fans as cooling functions.

In addition, an unrecoverable failure is explained as a failure at a fan in the first and second embodiments. However, the failure is not limited to this but may be other failures that may require repair or replacement of parts when the failure, such as malfunction or the like occurs.

What is claimed is:

1. An image forming device comprising:

an image forming unit that forms a developer image on a recording medium;

a first recording medium accommodation part and a second recording medium accommodation part that each accommodate the recording medium;

a failure detection part that detects occurrence of an unrecoverable failure; and a main controller that operates the image forming unit to form the developer image on the recording medium supplied only from the first recording medium accommodation part and that suspends supply of the recording medium from the second recording medium accommodation part, when the failure detection part detects the occurrence of an unrecoverable failure, wherein the first recording medium accommodation part and the second recording medium accommodation part are positioned such that a recording medium carrying distance from the first recording medium accommodation part to the image forming unit is shorter than a recording medium carrying distance from the second recording medium accommodation part to the image forming unit.

2. The image forming device according to claim 1, wherein the failure detection part detects the occurrence of an unrecoverable failure at a cooling device that cools at least one of a plurality of power consumption parts, and the main controller shifts to a load reduction mode under which a print operation is performed in which the amount of power supplied to the plurality of power consumption parts is suppressed, when the failure detection part detects the occurrence of an unrecoverable failure at the cooling device.

3. The image forming device according to claim 2, wherein the plurality of power consumption parts include a fuser that fixes a developer image transferred onto a recording medium to the recording medium, and the main controller extends a time interval between fusion operations performed by the fuser to be longer than a time interval that is used when the failure detection part does not detect the occurrence of an unrecoverable failure at the cooling device that cools the fuser, when the failure detection part detects the occurrence of an unrecoverable failure at the cooling device that cools the fuser.

4. The image forming device according to claim 2, wherein the plurality of power consumption parts include the main controller that controls a print operation to transfer a developer image onto a recording medium and to fix the developer image to the recording medium, and the main controller extends a time interval between print operations to be longer than a time interval that is used when the failure detection part does not detect the occurrence of an unrecoverable failure at the cooling device that cools the main controller, when the failure detection part detects the occurrence of an unrecoverable failure at the cooling device that cools the main controller.

5. The image forming device according to claim 2, wherein the plurality of power consumption parts include the main controller that controls printing of a developer image on a recording medium supplied from the first recording medium accommodation part or the second recording medium accommodation part, and the main controller suspends the supply of the recording medium from the second recording medium accommodation part, when the failure detection part detects the occurrence of an unrecoverable failure at the cooling device that cools the main controller.

6. The image forming device according to claim 1, wherein the failure detection part detects occurrence of an unrecoverable failure at a cooling device that cools the main controller, and the main controller operates the image forming unit to form the developer image on the recording medium supplied only from the first recording medium accommodation part and suspends supply of the recording medium from the second recording medium accommodation part, when the failure detection part detects the occurrence of an unrecoverable failure at the cooling device that cools the main controller.

7. An image forming device including a plurality of power consumption devices that operate by power supply and a plurality of cooling devices that cool a portion of the plurality of power consumption devices that requires cooling, wherein the plurality of power consumption parts include a fuser that fixes a developer image transferred onto a recording medium to the recording medium and a power source to which power is supplied from a commercial power source, the image forming device, comprising:

a failure detection part that detects occurrence of an unrecoverable failure at one of the plurality of cooling devices;

a tubular connection member that connects a fuser cooling area in which cooling air of one of the plurality of cooling devices that cools the fuser flows, and a power source cooling area in which cooling air of one of the plurality of cooling devices that cools the power source flows;

an openable and closeable isolation plate that isolates the cooling air that flows through the connection member; and a main controller that opens and closes the isolation plate based on detection of the occurrence of the unrecoverable failure by the failure detection part, wherein the main controller opens the isolation plate when the failure detection part detects the occurrence of an unrecoverable failure at the cooling device that cools the power supply, so that the cooling air from the fuser cooling area flows into the power source cooling area, and the main controller opens the isolation plate when the failure detection part detects the occurrence of an unrecoverable failure at the cooling device that cools the fuser, so that the cooling air from the power source cooling area flows into the fuser cooling area.

8. The image forming device according to claim 7, wherein the failure detection part detects the occurrence of an unrecoverable failure at the cooling device that cools the plurality of power consumption devices, and the main controller shifts to a load reduction mode under which a print operation is performed in which the amount of the power supplied to the plurality of power consumption parts is suppressed, when the failure detection part detects the occurrence of an unrecoverable failure at the cooling device.

9. The image forming device according to claim 8, wherein when the failure detection part detects the occurrence of an unrecoverable failure at the cooling device that cools the power source or the fuser, the main controller extends a time interval between fusion operations performed by the fuser to be longer than a time interval that is used when the failure detection part does not detect the occurrence of an unrecoverable failure at the cooling device that cools the power source or the fuser.

10. The image forming device according to claim 8, wherein the main controller suspends supply of a recording medium from the second recording medium accommodation part, when the failure detection part detects the occurrence of an unrecoverable failure at the cooling device that cools the power source.

11. The image forming device according to claim 8, wherein the main controller suspends supply of a recording medium from the second recording medium accommodation part, when the failure detection part detects the occurrence of an unrecoverable failure at the cooling device that cools the fuser.

12. A failure control system for an image forming device, comprising:

a plurality of power consumption parts including first and second heat generating parts;

first, second and third cooling parts that cool the first and second heat generating parts and a main controller, respectively;

a failure detection part configured to detect an unrecoverable failure at the first, second and third cooling parts;

an image forming unit that forms a developer image on a recording medium;

a first recording medium accommodation part and a second recording medium accommodation part that each accommodate the recording medium; and the main controller that controls the plurality of power consumption parts and the first, second and third cooling parts, wherein the main controller cuts power supply to a part of the plurality of power consumption parts when the failure detection part detects an unrecoverable failure at the first cooling part, the main controller operates the second heat generating part at predetermined time intervals between operations of the second heat generating part when the failure detection part detects an unrecoverable failure at the second cooling part, the predetermined time intervals being longer than normal time intervals, and the main controller operates the image forming unit to form the developer image on the recording medium supplied only from the first recording medium accommodation part and suspends supply of the recording medium from the second recording medium accommodation part when the failure detection part detects an unrecoverable failure at the third cooling part, and the first recording medium accommodation part and the second recording medium accommodation part are positioned such that a recording medium carrying distance from the first recording medium accommodation part to the image forming unit is shorter than a recording medium carrying distance from the second recording medium accommodation part to the image forming unit.

* * * * *